US005632615A

United States Patent [19]

DeGarmo

[11] Patent Number: 5,632,615

[45] Date of Patent: May 27, 1997

[54] COOKIE CUTTER CANDLE

[76] Inventor: Billy B. DeGarmo, 532 Court Ave., Weston, W. Va. 26452

[21] Appl. No.: 570,593

[22] Filed: Dec. 11, 1995

[51] Int. Cl.[6] ..... F23D 3/16

[52] U.S. Cl. ..... 431/288; 431/289; 264/247; 264/277; 249/94; 249/104

[58] Field of Search ..... 431/288, 126, 431/325, 289, 125; 249/94, 104; 264/250, 80, 234, 247, 277; 53/3

[56] References Cited

U.S. PATENT DOCUMENTS

| | | | |
|---|---|---|---|
| 1,576,205 | 3/1926 | Mertens | 431/288 X |
| 1,709,889 | 4/1929 | Tasker | 431/288 X |
| 1,726,304 | 8/1929 | Lewis | 431/288 X |
| 3,428,409 | 2/1969 | Summers | 431/289 |
| 3,741,711 | 6/1973 | Bryant | 431/125 |
| 3,744,956 | 7/1973 | Hess | 431/288 X |
| 3,907,245 | 9/1975 | Linder | 249/94 |
| 3,952,992 | 4/1976 | Vyprachticky | 249/104 |
| 3,983,677 | 10/1976 | Lundborn | 53/3 |
| 4,028,045 | 6/1977 | Reiher | 431/289 |
| 4,054,636 | 10/1977 | Menig | 264/250 |
| 4,170,860 | 10/1979 | Flinn et al. | 53/170 |
| 4,826,428 | 5/1989 | Lam | 431/289 |
| 5,395,233 | 3/1995 | Karp | 431/289 |

*Primary Examiner*—Larry Jones
*Attorney, Agent, or Firm*—Richard L. Miller, P.E.

[57] ABSTRACT

A decorative candle that includes an outer wax layer, at least one specifically shaped wax inlay, a wax plug, an inner wax filler, and a substantially rigid wick. The outer wax layer has a color, a first side, a second side, a top with a length, a bottom with a length, an outer surface, and at least one specifically shaped aperture being disposed therethrough. The at least one specifically shaped wax inlay has a color different than the color of the outer wax layer. Each of the at least one specifically shaped wax inlay is disposed in a respective one of the at least one specifically shaped aperture of the outer wax layer. The wax plug has a perimeter, a centrally disposed throughbore and is disposed at the top of the outer wax layer. The outer wax layer and the wax plug define a filler chamber. The inner wax filler has a bottom, a centrally longitudinally disposed throughbore, and is disposed within the filler chamber. And, the substantially rigid wick is disposed in the centrally longitudinally disposed throughbore of the inner wax filler.

33 Claims, 3 Drawing Sheets

COOKIE CUTTER CANDLE

BACKGROUND OF THE INVENTION

The present invention relates to a cookie cutter candle. More particularly, the present invention relates to a cookie cutter candle that includes a cylindrical wax body, an exterior wax layer disposed about the outer surface of the cylindrical wax body and having cookie cutter cutouts, and wax inserts disposed in the cookie cutter cutouts.

The ancient art of candling making is creative, rewarding, challenging, and enjoys much popularity. The challenge involves making candles in many unusual and decorative shapes and colors.

Some of the finest examples of the candle making art are those in which the surface of the candle is overlaid in some fashion with relief decorations, often in different colors. This is usually accomplished with an expensive two section separable mold which is used to produce the decorations at the same time the main candle is being fashioned. Thereafter, the decoration is hand painted. Molds of this type are expensive and possess little versatility.

A need exists, therefore, for an inexpensive and simple way to inlay the surface of a candle with one or more decorative inserts which may be the same or, preferably, a different color from the main candle.

Numerous innovations for candle devices have been provided in the prior art that will be described. However, even though these innovations may be suitable for the specific individual purposes to which they address, they differ from the present invention in that they do not teach a cookie cutter candle that includes a cylindrical wax body, an exterior wax layer disposed about the outer surface of the cylindrical wax body and having cookie cutter cutouts, and wax inserts disposed in the cookie cutter cutouts.

For example, U.S. Pat. No. 3,741,711 to Bryant teaches a shaped candle that is formed of clear, undyed, and unpigmented candle wax. The candle has only surface ornamentation and coloration and includes a glass cylinder recessed centrally thereof and a cylinder of translucent insulating material positioned inside the glass cylinder.

Another example, U.S. Pat. No. 3,907,245 to Linder teaches a flexible bipart mold for making candles that includes a plurality of integral, manipulable mold locks or latches for locking the mold sections together.

Still another example, U.S. Pat. No. 3,952,992 to Vyprachhtocky teaches an inlay candle mold that includes an open-topped shallow marginally-rimmed reservoir shaped to define a decorative insert into which molten wax is poured and allowed to set. Hooking forming means is provided for suspending the filled reservoir in an upright position from the rim of a candle mold flush against the wall thereof and facing inwardly therefrom.

Yet another example, U.S. Pat. No. 4,054,636 to Menig teaches a method of making a candle that includes the steps of extending a wick centrally through a candle mold, forming initially a wax shell on the surface of the mold having one open end, filling the wax shell with powered wax, and sealing the open end of the wax shell to contain the powered wax therein.

Finally, Still yet another example, U.S. Pat. No. 4,170,860 to Flinn et al. teaches a system for making candles that includes an overhead conveyor, a wicking station, a dipping station, a cutoff station, a butt forming station, and a cutdown station.

It is apparent that numerous innovations for candle devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a cookie cutter candle that avoids the disadvantages of the prior art.

Another object of the present invention is to provide a cookie cutter candle that is simple and inexpensive to manufacture.

Still another object of the present invention is to provide a cookie cutter candle that is simple to use.

Yet another object of the present invention is to provide a cookie cutter candle that opens limitless possibilities for scenic and holiday candles as cutters are available in every shape imaginable.

Briefly stated, still yet another object of the present invention is to provide a cookie cutter candle that includes an outer wax layer, at least one specifically shaped wax inlay, a wax plug, an inner wax filler, and a substantially rigid wick.

Yet still another object of the present invention is to provide a cookie cutter candle wherein the outer wax layer has a color, a first side, a second side, a top with a length, a bottom with a length, an outer surface, and at least one specifically shaped aperture being disposed therethrough.

Still yet another object of the present invention is to provide a cookie cutter candle wherein the at least one specifically shaped wax inlay has a color different than the color of the outer wax layer.

Yet still another object of the present invention is to provide a cookie cutter candle wherein each of the at least one specifically shaped wax inlay is disposed in a respective one of the at least one specifically shaped aperture of the outer wax layer.

Still yet another object of the present invention is to provide a cookie cutter candle wherein the wax plug has a perimeter, a centrally disposed throughbore and is disposed at the top of the outer wax layer.

Yet still another object of the present invention is to provide a cookie cutter candle wherein the outer wax layer and the wax plug define a filler chamber.

Still yet another object of the present invention is to provide a cookie cutter candle wherein the inner wax filler has a bottom, a centrally longitudinally disposed throughbore, and is disposed within the filler chamber.

Yet still another object of the present invention is to provide a cookie cutter candle wherein the substantially rigid wick is disposed in the centrally longitudinally disposed throughbore of the inner wax filler.

Still yet another object of the present invention is to provide a cookie cutter candle wherein the length of the top of the outer wax layer is less than the length of the bottom of the outer wax layer.

Yet still another object of the present invention is to provide a cookie cutter candle wherein the first side of the outer wax layer tapers inwardly towards the second side of the outer wax layer so that when the outer wax layer is rolled and the first side of the outer wax layer meets the second side of the outer wax layer a hollow frustrum is formed that tapers upwardly towards the top of the outer wax layer.

Still yet another object of the present invention is to provide a cookie cutter candle wherein the wax plug has a diameter of at least 4" and the centrally disposed throughbore of the wax plug has a diameter of ¼"–2" to increase translucent quality therethrough.

Yet still another object of the present invention is to provide a cookie cutter candle wherein the outer wax layer and the at least one wax inlay have a thickness of ¼" to ¾" to increase translucent quality therethrough.

Still yet another object of the present invention is to provide a cookie cutter candle wherein the outer wax layer and the at least one wax inlay are made from 2 tablespoons of Mico 845, 4 teaspoons of Mico BS, ¼ teaspoon of Uvli, and 3 teaspoons of Fisher Trop 1 added to 4 pounds of wax having a melting point of 140 degrees F. so that stretch ability and adhesion is increased therebetween.

Yet still another object of the present invention is to provide a cookie cutter candle wherein the inner wax filler includes a plurality of irregularly shaped solid translucent wax chunks that have voids therebetween.

Still yet another object of the present invention is to provide a cookie cutter candle wherein the plurality of irregularly shaped solid translucent wax chunks are made from 1–2 teaspoons of Fisher Trop 1 added to 4 pounds of wax having a 140 degree F. melting point.

Yet still another object of the present invention is to provide a cookie cutter candle wherein the inner wax filler further includes clear wax disposed in the voids between the plurality of irregularly shaped solid translucent wax chunks and in the centrally disposed throughbore of the wax plug.

Still yet another object of the present invention is to provide a cookie cutter candle wherein the inner wax filler further includes a pair of longitudinally disposed crescent shaped opposing voids that open into the bottom of the inner wax filler and extend to a point short of the wax plug.

Yet still another object of the present invention is to provide a cookie cutter candle wherein the inner wax filler further includes the clear wax disposed in the pair of longitudinally disposed crescent shaped opposing voids.

Still yet another object of the present invention is to provide a cookie cutter candle wherein the clear wax is made from 1–2 teaspoons of Fisher Trop 1, ¼ teaspoon Uvli, and Mico 1702 added to 4 pounds of wax having a 140 degree F. melting point.

Yet still another object of the present invention is to provide a cookie cutter candle wherein the outer surface of the outer wax layer includes additional colored decorative details.

Still yet another object of the present invention is to provide a cookie cutter candle wherein the at least one specifically shaped aperture of the outer wax layer is a moon shaped aperture.

Yet still another object of the present invention is to provide a cookie cutter candle wherein the at least one specifically shaped aperture of the outer wax layer is a sled shaped aperture.

Still yet another object of the present invention is to provide a cookie cutter candle wherein the at least one specifically shaped aperture of the outer wax layer is a Santa Claus shaped aperture.

Yet still another object of the present invention is to provide a cookie cutter candle wherein the at least one specifically shaped aperture of the outer wax layer is a reindeer shaped aperture.

Still yet another object of the present invention is to provide a cookie cutter candle wherein the at least one specifically shaped wax inlay is a moon shaped wax inlay.

Yet still another object of the present invention is to provide a cookie cutter candle wherein the at least one specifically shaped wax inlay is a sled shaped wax inlay.

Still yet another object of the present invention is to provide a cookie cutter candle wherein the at least one specifically shaped wax inlay is a Santa Claus shaped wax inlay.

Yet still another object of the present invention is to provide a cookie cutter candle wherein the at least one specifically shaped wax inlay is a reindeer shaped.

Still yet another object of the present invention is to provide a cookie cutter candle that further includes at least one cookie cutter.

Yet still another object of the present invention is to provide a cookie cutter candle wherein the at least one cookie cutter is a moon shaped cookie cutter that matches the moon shaped aperture of the at least one specifically shaped aperture of the outer wax layer and matches the moon shaped wax inlay of the at least one specifically shaped wax inlay.

Still yet another object of the present invention is to provide a cookie cutter candle wherein the at least one cookie cutter is a sled shaped cookie cutter that matches the sled shaped aperture of the at least one specifically shaped aperture of the outer wax layer and matches the sled shaped wax inlay of the at least one specifically shaped wax inlay.

Yet still another object of the present invention is to provide a cookie cutter candle wherein the at least one cookie cutter is a Santa Claus shaped cookie cutter that matches the Santa Claus shaped aperture of the at least one specifically shaped aperture of the outer wax layer and matches the Santa Claus shaped wax inlay of the at least one specifically shaped wax inlay.

Still yet another object of the present invention is to provide a cookie cutter candle wherein the at least one cookie cutter is a reindeer shaped cookie cutter that matches the reindeer shaped aperture of the at least one specifically shaped aperture of the outer wax layer and matches the reindeer shaped wax inlay of the at least one specifically shaped wax inlay.

Yet still another object of the present invention is to provide a method of making a cookie cutter candle that includes the steps of making an outer wax layer of the decorative candle, cutting at least one specifically shaped aperture in the outer wax layer, making an inlay wax layer of the decorative candle, cutting at least one specifically shaped inlay from the inlay wax layer, placing the at least one specifically shaped inlay into a respective one of the at least one specifically shaped aperture in the outer wax layer, kneading the at least one specifically shaped inlay to the outer wax layer, heating the combination of the at least one specifically shaped inlay and the outer wax layer at 120–140 degrees F. until soft and bonded, rolling the combination of the at least one specifically shaped inlay and the outer wax layer, placing the combination of the at least one specifically shaped inlay and the outer wax layer into a warmed mold having an open top and a closed bottom, unrolling slowly the combination of the at least one specifically shaped inlay and the outer wax layer, positioning the combination of the at least one specifically shaped inlay and the outer wax layer with a top of the outer wax layer against the closed bottom of the warmed mold and with a tapered first side of the outer wax layer meeting a straight second side of the outer wax layer and forming a hollow frustrum, kneading the tapered first side of the outer wax layer to the straight second side of the outer wax layer to fill any gaps therebetween, placing a wax plug of the decorative candle in the warmed mold against the closed bottom of the warmed mold with a perimeter of the wax plug pressing firmly against the top of the outer wax layer, kneading the perimeter of the wax plug to the top of the outer wax layer to fill any gaps therebetween, placing a L-shaped metal release rod having a longitudinal portion and a transverse portion extending outwardly from the longitudinal portion of the L-shaped metal release into the warmed mold with the longitudinal portion of the L-shaped metal release rod positioned in a centrally disposed throughbore of the wax plug and the transverse portion of the L-shaped metal release rod extending outwardly from the warmed mold open top of the warmed mold, pouring a plurality of irregularly shaped solid translucent wax chunks of the decorative candle into the warmed mold until full and help keep the outer wax layer in place in the warmed mold, pouring hot molten clear wax of the decorative candle, at a temperature of 220–240 degrees F., into the warmed mold surrounding the plurality of irregularly shaped solid translucent wax chunks and the longitudinal portion of the L-shaped metal release rod and entering the centrally disposed throughbore of the wax plug until full, setting the combination of the hot molten clear wax, the plurality of irregularly shaped solid translucent wax chunks, the L-shaped metal release rod, and the warmed mold for 30–45 seconds, placing the combination of the hot molten clear wax, the plurality of irregularly shaped solid translucent wax chunks, the L-shaped metal release rod, and the warmed mold into a water bath to be cooled, making a pair of longitudinally disposed crescent shaped opposing voids in the hot molten clear wax with the pair of longitudinally disposed crescent shaped opposing voids opening into the open top of the warmed mold and extending to a point short of the wax plug as the hot molten clear wax becomes a mush, pouring additional hot molten clear wax into the pair of longitudinally disposed crescent shaped opposing voids, hardening the additional hot molten clear wax and forming an inner wax filler of the decorative candle, removing the combination of the white inner wax filler, the wax plug, the outer wax layer, the at least one specifically shaped wax inlay, and the L-shaped metal release rod from the warmed mold and inverting so that the wax plug faces upward, removing the L-shaped metal release rod from a centrally longitudinally disposed throughbore of the inner wax filler from a bottom of the white inner wax filler, inserting a warmed substantially rigid wick in the centrally longitudinally disposed throughbore of the inner wax filler, placing the combination of the inner wax filler, the wax plug, the outer wax layer, the substantially rigid wick, and the at least one specifically shaped wax inlay on a hot plate with the bottom of the inner wax filler in contact therewith, heating the hot plate to a temperature of 225–250 degrees F., and leveling the bottom of the inner wax filler and securing the substantially rigid wick thereto.

Still yet another object of the present invention is to provide a method of making a cookie cutter candle that further includes the step of applying additional colored decorative details to the combination of the outer wax layer and the at least one specifically shaped wax inlay by a brush.

Yet still another object of the present invention is to provide a method of making a cookie cutter candle wherein the outer wax layer and the inlay wax layer have a thickness of ¼" to ¾" to increase translucent quality therethrough.

Still yet another object of the present invention is to provide a method of making a cookie cutter candle wherein the outer wax layer and the inlay wax layer are made by a method that includes the steps of adding 2 tablespoons of Mico 845, 4 teaspoons of Mico BS, ¼ teaspoon of Uvli, and 3 teaspoons of Fisher Trop 1 to 4 pounds of wax to increase ability to stretch and increase between components adhesion therebetween.

Yet still another object of the present invention is to provide a method of making a cookie cutter candle wherein the method of making the outer wax layer and the inlay wax layer further includes the steps of pouring into a pre-warmed sheet pan, placing in a low temperature oven of 130–160 degrees F. until pliable, removing, and cooling.

Still yet another object of the present invention is to provide a method of making a cookie cutter candle wherein the step of cutting the at least one specifically shaped aperture in the outer wax layer and the step of cutting the at least one specifically shaped inlay from the inlay wax layer is accomplished by a cookie cutter.

Yet still another object of the present invention is to provide a method of making a cookie cutter candle wherein the plurality of irregularly shaped solid translucent wax chunks is made by a method that includes the step of adding 1–2 teaspoons of Fisher Trop 1 to 4 pounds of wax having a 140 degree F. melting point.

Finally, still yet another object of the present invention is to provide a method of making a cookie cutter candle wherein the hot molten clear wax and the additional hot molten clear wax are made by a method that includes the steps of adding 1–2 teaspoons of Fisher Trop 1, ¼ teaspoon Uvli, and Mico 1702 to 4 pounds of wax having a 140 degree F. melting point.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

| | |
|---|---|
| 10 | cookie cutter candle of the present invention |
| 12 | blue outer wax layer |
| 14 | blue outer wax layer top |
| 15 | blue outer wax layer bottom |
| 16 | at least one blue outer wax layer specifically shaped aperture |
| 16-1 | moon shaped aperture |
| 16-2 | sled shaped aperture |
| 16-3 | Santa Claus shaped aperture |
| 16-4 | reindeer shaped aperture |
| 18 | at least one specifically shaped wax inlay |
| 18-1 | yellow moon shaped inlay |
| 18-2 | brown sled shaped inlay |
| 18-3 | red Santa Claus shaped inlay |
| 18-4 | brown reindeer shaped inlay |
| 20 | blue wax plug |
| 21 | blue plug perimeter |
| 22 | centrally disposed blue wax plug throughbore |
| 24 | white inner wax filler |
| 26 | centrally longitudinally disposed white inner wax filler throughbore |
| 28 | substantially rigid wick |
| 30 | blue outer wax layer tapered first side |
| 32 | blue outer wax layer straight second side |
| 34-1 | moon shaped cookie cutter |
| 34-2 | sled shaped cookie cutter |
| 34-3 | Santa Claus shaped cookie cutter |
| 34-4 | reindeer shaped cookie cutter |
| 36 | yellow layer of wax |
| 38 | brown layer of wax |
| 40 | red layer of wax |
| 42 | warmed mold |
| 44 | warmed mold open top |
| 46 | warmed mold closed bottom |
| 48 | L-shaped metal release rod |
| 50 | L-shaped metal release rod longitudinal portion |
| 52 | L-shaped metal release rod transverse portion |
| 54 | plurality of irregularly shaped solid translucent wax chunks |
| 56 | hot molten clear wax |
| 58 | pitcher |
| 60 | water bath |
| 62 | pair of longitudinally disposed crescent shaped opposing voids |
| 64 | additional hot molten clear wax |
| 66 | white inner wax filler bottom |
| 68 | hot plate |
| 70 | additional colored decorative details |
| 72 | brush |
| 74 | hand |
| 76 | flame |
| 78 | substantially hemispherical recess |
| 80 | light |

DETAILED DESCRIPTION OF THE PREFERRED EMBODIMENT

Figure 1:
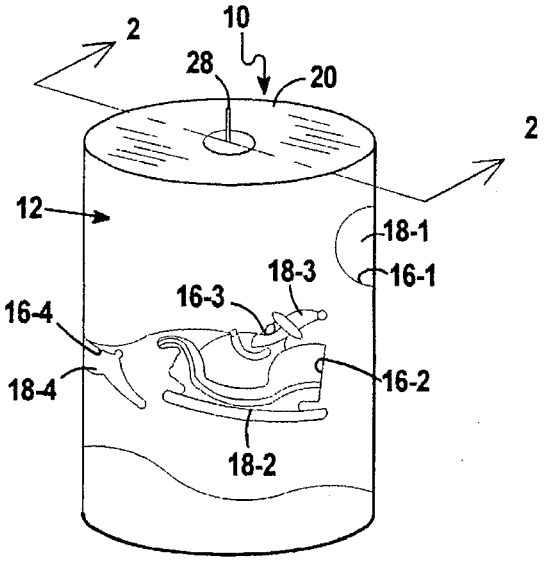
FIG. 1 is a diagrammatic perspective view of the present invention with a Christmas scene typically illustrated thereon.
Figure 2:
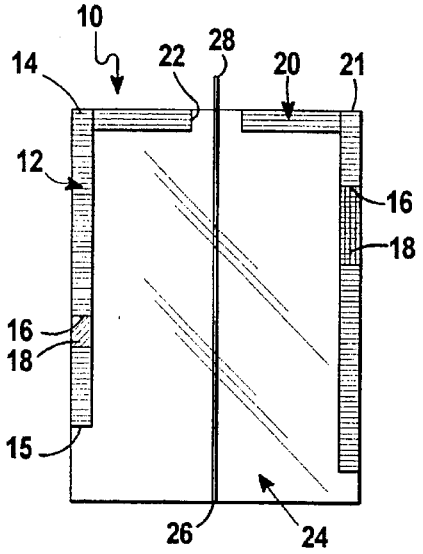
FIG. 2 is a cross sectional view taken on line 2—2 in FIG. 1.

Referring now to the figures in which like numerals indicate like parts, and particularly to FIGS. 1 and 2, the cookie cutter candle of the present invention is shown generally at 10.

The cookie cutter candle 10 includes a blue outer wax layer 12 with a blue outer wax layer top 14, a blue outer wax layer bottom 15 and having at least one blue outer wax layer specifically shaped aperture 16.

One of at least one specifically shaped wax inlay 18 is disposed in a respective one of the at least one blue outer wax layer specifically shaped aperture 16 of the blue outer wax layer 12.

A blue wax plug 20 with a diameter of at least 4" having a blue plug perimeter 21 and a centrally disposed blue wax plug throughbore 22 with a diameter of ¼"–2", is disposed at the blue outer wax layer top 14 of the blue outer wax layer 12.

A white inner wax filler 24 having a centrally longitudinally disposed white inner wax filler throughbore 26 is disposed within the confines of the blue outer wax layer 12 and the blue the wax plug 20.

A substantially rigid wick 28 is disposed in the centrally longitudinally disposed white inner wax filler throughbore 26 of the white inner wax filler 24.

The configuration of the blue outer wax layer 12 and the at least one specifically shaped wax inlay 18 can best be seen in FIGS. 3–6, and as such, will be discussed with reference thereto.

It is to be understood that the shape and amount of the at least one outer wax layer specifically shaped aperture 16 of the outer wax layer 12, the color of the outer wax layer 12, and the shape, color, and amount of the at least one specifically shaped wax inlay 18 are shown for illustrative purposes only and that any shape, color, and amount can be used depending upon user need, desire, and purpose, etc.

The color of the at least one specifically shaped wax inlay 18, however, is different than the color of the outer wax layer 12. Contrasting colors work well and little bleeding of colors occurs.

Figure 3:
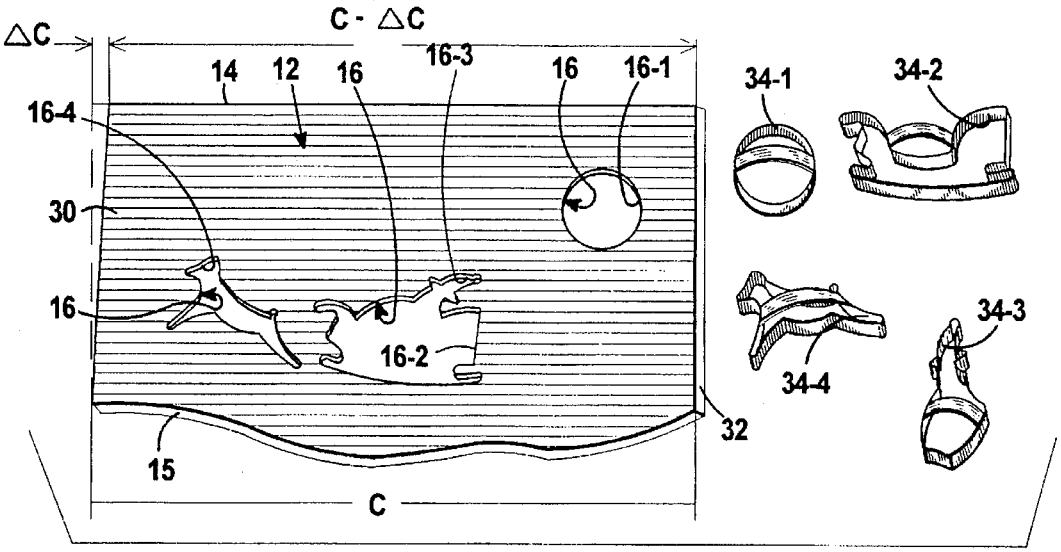
FIG. 3 is a diagrammatic perspective view illustrating the outer wax layer with decorative shapes removed accordingly by the cookie cutters shown.

As shown in FIG. 3, the length of the blue outer wax layer top 14 of the blue outer wax layer 12 is less than the length of the blue outer wax layer bottom 15 of the blue outer wax layer 12. With this configuration, a blue outer wax layer tapered first side 30 tapers inwardly towards a blue outer wax layer straight second side 32 so that when the blue outer wax layer 12 is rolled and the blue outer wax layer tapered first side 30 of the blue outer wax layer 12 meets the blue outer wax layer straight second side 32 of the blue outer wax layer 12, a frustrum configuration is formed that tapers upwardly towards the blue outer wax layer top 14 of the blue outer wax layer 12.

One of the at least one blue outer wax layer specifically shaped aperture 16 of the blue outer wax layer 12 is a moon shaped aperture 16-1.

Another one of the at least one blue outer wax layer specifically shaped aperture 16 of the blue outer wax layer 12 is a sled shaped aperture 16-2.

Another one of the at least one blue outer wax layer specifically shaped aperture 16 of the blue outer wax layer 12 is a Santa Claus shaped aperture 16-3 that intersect the sled shaped aperture 16-2.

And, another one of the at least blue one outer wax layer specifically shaped aperture 16 of the blue outer wax layer 12 is a reindeer shaped aperture 16-4.

The moon shaped aperture 16-1 is made by a moon shaped cookie cutter 34-1. The sled shaped aperture 16-2 is made by a sled shaped cookie cutter 34-2. The Santa Claus shaped aperture 16-3 is made by a Santa Claus shaped cookie cutter 34-3. And, the reindeer shaped aperture 16-4 is made by a reindeer shaped cookie cutter 34-4.

Figure 4:
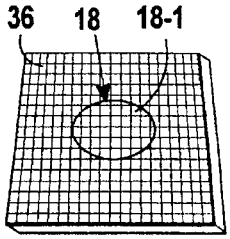
FIG. 4 is a diagrammatic perspective view illustrating a sheet of wax with a moon inlay cut therein.

As shown in FIG. 4, one of the at least one specifically shaped wax inlay 18 is a yellow moon shaped inlay 18-1 made from a yellow layer of wax 36 by the moon shaped cookie cutter 34-1.

Figure 5:
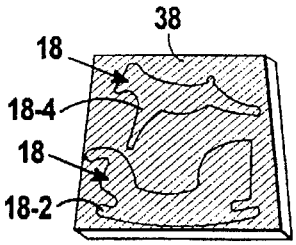
FIG. 5 is a diagrammatic perspective view illustrating a sheet of wax with a reindeer and a sleigh inlays cut therein.

As shown in FIG. 5, another one of the at least one specifically shaped wax inlay 18 is a brown sled shaped inlay 182 made from a brown layer of wax 38 by the sled shaped cookie cutter 34-2.

Another one of the at least one specifically shaped wax inlay 18 is a brown reindeer shaped inlay 18-4 made from the brown layer of wax 38 by the reindeer shaped cookie cutter 34-4.

Figure 6:
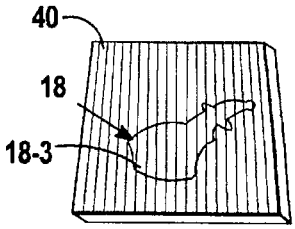
FIG. 6 is a diagrammatic perspective view illustrating a sheet of wax with a Santa Claus inlay cut therein.

And, as shown in FIG. 6, another one of the at least one specifically shaped wax inlay 18 is a red Santa Claus shaped inlay 18-3 made from a red layer of wax 40 by the Santa Claus shaped cookie cutter 34-3.

The method of making the cookie cutter candle 10 can best be seen in FIGS. 1 and 3-12, and as such, will be discussed with reference thereto.

The blue outer wax layer 12, the yellow layer of wax 36, the brown layer of wax 38, the red layer of wax 40, and the blue wax plug 20 have a thickness of ¼" to ¾" (decreasing thickness increases translucent quality) and are prepared as follows.

2 tablespoons of Mico 845, 4 teaspoons of Mico BS, ¼ teaspoon of Uvli (sunlight inhibitor), and 3 teaspoons of Fisher Trop 1 are added to 4 pounds of wax to increase its ability to stretch and increase adhesion between components.

The combination of the 2 tablespoons of mico 845, the 4 teaspoons of mico BS, the ¼ teaspoon of uvli (sunlight inhibitor), the 3 teaspoons of Fisher Trop 1, and the4 pounds of wax is poured into a pre-warmed sheet pan and placed in a low temperature oven of 130–160 degrees F. until pliable. It is then removed, allowed to cool, and then using a Quilon baking sheet cut into the desired size for the candle to be made. If necessary, it can be returned to the oven to become more pliable.

Different colors require some variations as they cause melting points to vary. Heating time varies depending on climate and number of candles being prepared.

As shown in FIG. 3, the moon shaped aperture 16-1 of the at least one blue outer wax layer specifically shaped aperture 16 of the blue outer wax layer 12 is precut into the blue outer wax layer 12 by the moon shaped cookie cutter 34-1.

The sled shaped aperture 16-2 of the at least one blue outer wax layer specifically shaped aperture 16 of the blue outer wax layer 12 is precut into the blue outer wax layer 12 by the sled shaped cookie cutter 34-2.

The Santa Claus shaped aperture 16-3 of the at least one blue outer wax layer specifically shaped aperture 16 of the blue outer wax layer 12 is precut into the blue outer wax layer 12 by the Santa Claus shaped cookie cutter 34-3.

The reindeer shaped aperture 16-4 of the at least one blue outer wax layer specifically shaped aperture 16 of the blue outer wax layer 12 is precut into the blue outer wax layer 12 by the reindeer shaped cookie cutter 34-4.

And, the at least one blue outer wax layer specifically shaped aperture 16 of the blue outer wax layer 12 can be a star shaped aperture (not shown) that is free of any of the at least one specifically shaped wax inlay 18 and filled by the white inner wax filler 24 so that an glow effect and adhesion of components are provided.

As shown in FIG. 4, the yellow moon shaped inlay 18-1 of the at least one specifically shaped wax inlay 18 is precut from the yellow layer of wax 36 by the moon shaped cookie cutter 34-1.

As shown in FIG. 5, the brown sled shaped inlay 18-2 of the at least one specifically shaped wax inlay 18 is precut from the brown layer of wax 38 by the sled shaped cookie cutter 34-2.

The brown reindeer shaped inlay 18-4 of the at least one specifically shaped wax inlay 18 is precut from the brown layer of wax 38 by the reindeer shaped cookie cutter 34-4.

And, as shown in FIG. 6, the red Santa Claus shaped inlay 18-3 of the at least one specifically shaped wax inlay 18 is precut from the red layer of wax 40 by the Santa Claus shaped cookie cutter 34-3.

As shown in FIG. 1, the yellow moon shaped inlay 18-1 of the at least one specifically shaped wax inlay 18 is pressed into the moon shaped aperture 16-1 of the at least one blue outer wax layer specifically shaped aperture 16 of the blue outer wax layer 12 by hand and kneaded to close any gaps and to increase adhesion therebetween.

The brown sled shaped inlay 18-2 of the at least one specifically shaped wax inlay 18 is pressed into the sled shaped aperture 16-2 of the at least one blue outer wax layer specifically shaped aperture 16 of the blue outer wax layer 12 by hand and kneaded to close any gaps and to increase adhesion therebetween.

The red Santa Claus shaped inlay 18-3 of the at least one specifically shaped wax inlay 18 is pressed into the Santa Claus shaped aperture 16-3 of the at least one blue outer wax layer specifically shaped aperture 16 of the blue outer wax layer 12 by hand and kneaded to close any gaps and to increase adhesion therebetween.

And, the brown reindeer shaped inlay 18-4 of the at least one specifically shaped wax inlay 18 is pressed into the reindeer shaped aperture 16-4 of the at least one blue outer wax layer specifically shaped aperture 16 of the blue outer wax layer 12 by hand and kneaded to close any gaps and to increase adhesion therebetween.

The combination of the blue outer wax layer 12, the yellow moon shaped inlay 18-1 of the at least one specifically shaped wax inlay 18, the sled shaped inlay 18-2 of the at least one specifically shaped wax inlay 18, the red Santa Claus shaped inlay 18-3 of the at least one specifically shaped wax inlay 18, and the brown reindeer shaped inlay 18-4 of the at least one specifically shaped wax inlay 18 is heated at 120–140 degrees F. until soft and bonded.

The heated combination of the blue outer wax layer 12, the yellow moon shaped inlay 18-1 of the at least one specifically shaped wax inlay 18, the sled shaped inlay 18-2 of the at least one specifically shaped wax inlay 18, the red Santa Claus shaped inlay 18-3 of the at least one specifically shaped wax inlay 18, and the brown reindeer shaped inlay 18-4 is rolled with the blue outer wax layer tapered first side 30 of the blue outer wax layer meeting the blue outer wax layer straight second side 32 of the blue outer wax layer 12.

Figure 7:
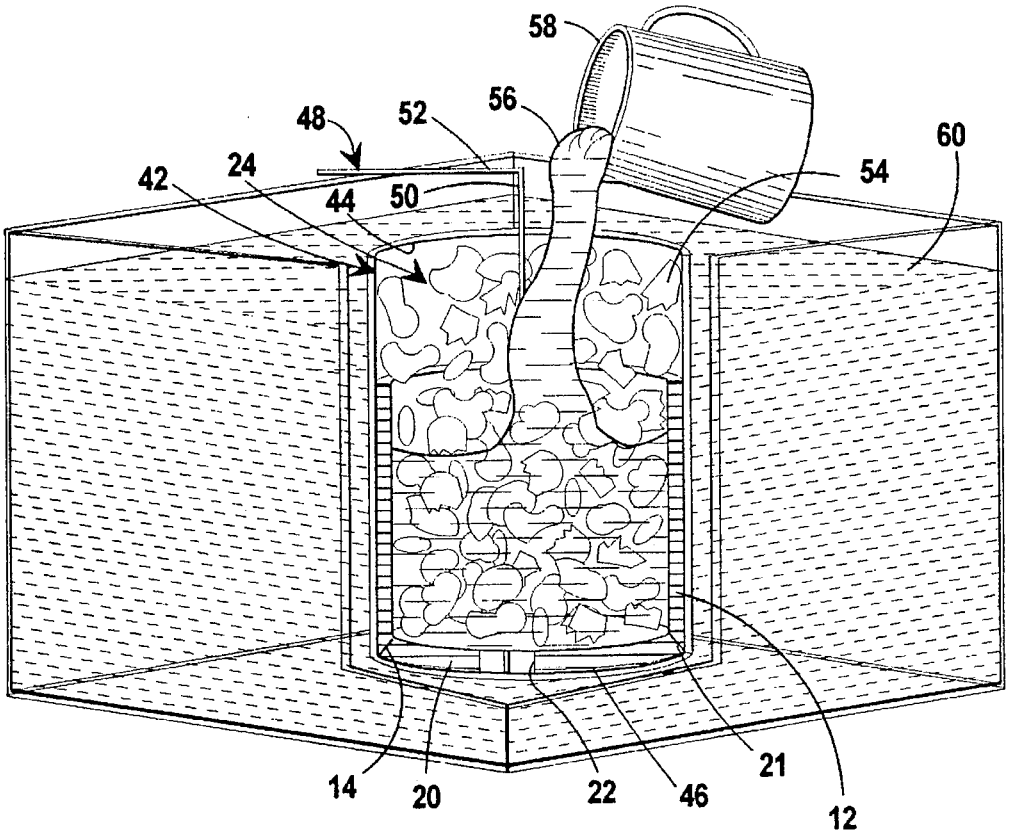
FIG. 7 is a diagrammatic perspective view, with parts broken away, illustrating a typical setup being utilized to fabricate a candle according to the present invention.

As shown in FIG. 7, the rolled heated combination of the blue outer wax layer 12, the yellow moon shaped inlay 18-1 of the at least one specifically shaped wax inlay 18, the sled shaped inlay 18-2 of the at least one specifically shaped wax inlay 18, the red Santa Claus shaped inlay 18-3 of the at least one specifically shaped wax inlay 18, and the brown reindeer shaped inlay 18-4 is placed into a warmed mold 42 having a warmed mold open top 44 and a warmed mold closed bottom 46 and slowly unrolled.

The unrolled heated combination blue outer wax layer 12, the yellow moon shaped inlay 18-1 of the at least one specifically shaped wax inlay 18, the sled shaped inlay 18-2 of the at least one specifically shaped wax inlay 18, the red Santa Claus shaped inlay 18-3 of the at least one specifically shaped wax inlay 18, and the brown reindeer shaped inlay 18-4 is positioned with the blue outer wax layer top 14 of the blue outer wax layer 12 against the warmed mold closed bottom 46 of the warmed mold 42.

The blue outer wax layer tapered first side 30 of the blue outer wax layer 12 is pressed firmly against the blue outer wax layer straight second side 32 of the blue outer wax layer 12 and kneaded by hand to fill any gaps therebetween.

The blue wax plug 20 is placed in the warmed mold against the warmed mold closed bottom 46 of the warmed mold 42 with the blue wax plug perimeter 21 of the blue wax plug 20 pressed firmly against the blue outer wax layer top 14 of the blue outer wax layer 12 and kneaded by hand to fill any gaps therebetween.

A L-shaped metal release rod 48 having a L-shaped metal release rod longitudinal portion 50 and a L-shaped metal release rod transverse portion 52 extending outwardly from the L-shaped metal release rod longitudinal portion 50 of the L-shaped metal release rod 48 is placed into the warmed mold 42 with the L-shaped metal release rod longitudinal portion 50 of the L-shaped metal release rod 48 positioned in the centrally disposed blue wax plug throughbore 22 of the blue wax plug 20 and the L-shaped metal release rod transverse portion 52 of the L-shaped metal release rod 48 extending outwardly from the warmed mold open top 44 of the warmed mold 42.

A plurality of irregularly shaped solid translucent wax chunks 54 are poured into the warmed mold 42 until full and help keep the blue outer wax layer 12 in place before it is filled. The plurality of irregularly shaped solid translucent wax chunks 54 are made from 1–2 teaspoons of Fisher Trop 1 added to4 pounds of wax having a 140 degree F. melting point.

Hot molten clear wax 56 is prepared by adding 1–2 teaspoons of Fisher Trop 1, ¼ teaspoon Uvli, and Mico 1702 to4 pounds of wax having a 140 degree F. melting point.

The Hot molten clear wax 56, at a temperature of 220–240 degrees F., is poured from a pitcher 58 into the warmed mold 42 surrounding the plurality of irregularly shaped solid translucent wax chunks 54 and the L-shaped metal release rod longitudinal portion 50 of the L-shaped metal release rod 48 and entering the centrally disposed blue wax plug throughbore 22 of the blue wax plug 20 until full.

The combination of the hot molten clear wax 56, the plurality of irregularly shaped solid translucent wax chunks 54, the L-shaped metal release rod 48, and the warmed mold 42 is allowed to set for 30–45 seconds and placed into a water bath 60 to be cooled.

Figure 8:
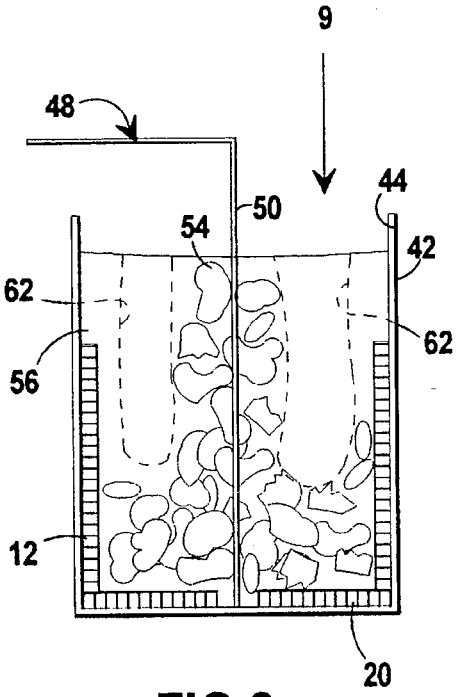
FIG. 8 is a diagrammatic cross sectional view illustrating the candle hardening with voids forming therein.
Figure 9:
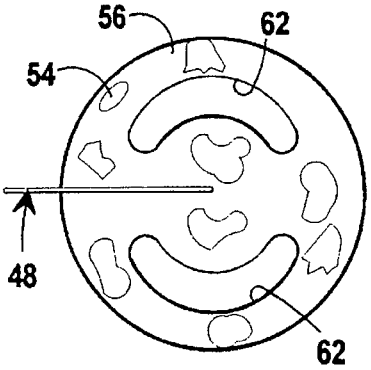
FIG. 9 is a diagrammatic top elevational view taken in the direction of arrow 9 in FIG. 8.

As shown in FIGS. 8 and 9, as the combination of the hot molten clear wax 56, the plurality of irregularly shaped solid translucent wax chunks 54, the L-shaped metal release rod 48, and the warmed mold 42 cools and the combination of the hot molten white wax 56 and the plurality of irregularly shaped solid translucent wax chunks 54 becomes a mush, a pair of longitudinally disposed crescent shaped opposing voids 62 are made therein. The pair of longitudinally disposed crescent shaped opposing voids 62 open into the warmed mold open top 44 of the warmed mold 42 and extend to a point short of the blue wax plug 20.

The pair of longitudinally disposed crescent shaped opposing voids 62 allow air to enter the combination of the hot molten white wax 56 and the plurality of irregularly shaped solid translucent wax chunks 54 to prevent the combination of the hot molten white wax 56 and the plurality of irregularly shaped solid translucent wax chunks 54, as it hardens, from shrinking, acquiring hidden voids, separating from the blue outer wax layer 12, the blue wax plug 20, and the L-shaped metal release rod longitudinal portion 50 of the L-shaped metal release rod 48, and to prevent the blue outer wax layer 12 and the blue wax plug 20 from separating from the warmed mold 42.

Figure 10:
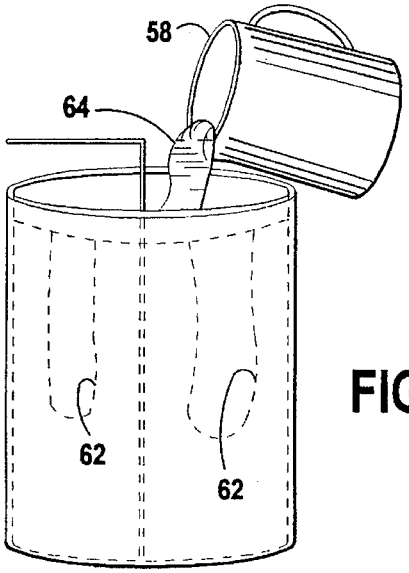
FIG. 10 is a diagrammatic perspective view illustrating the voids being filled with additional molten wax.

As shown in FIG. 10, when the combination of the hot molten white wax 56 and the plurality of irregularly shaped solid translucent wax chunks 54 hardens, additional hot molten clear wax 64 is poured from the pitcher 58, into and fills, the pair of longitudinally disposed crescent shaped opposing voids 62.

The additional hot molten clear wax 64 is prepared by adding 1–2 teaspoons of Fisher Trop 1, ¼ teaspoon Uvli, and Mico 1702 to 4 pounds of wax having a 140 degree F. melting point.

The combination of the hardened hot molten white wax 56, the plurality of irregularly shaped solid translucent wax chunks 54, and the hardened additional hot molten clear wax 64, form the white inner wax filler 24.

Figure 11:
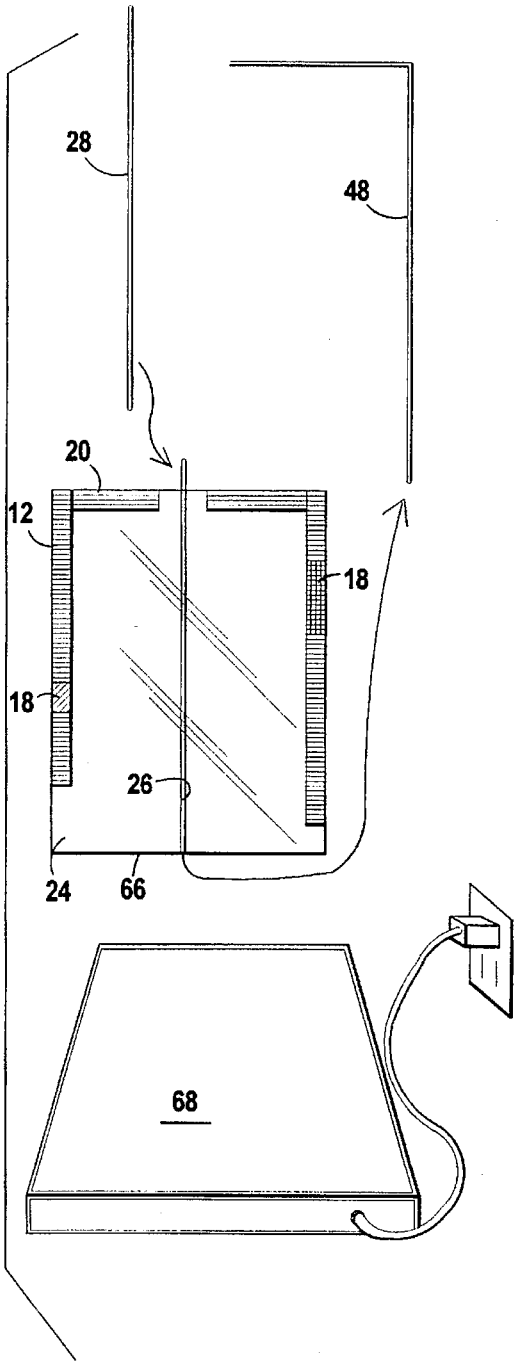
FIG. 11 is a diagrammatic perspective view illustrating the rod being removed from the bottom of the candle, the wick being installed therein, and the bottom thereof about to be leveled by a hot plate.

As shown in FIG. 11, after the additional hot molten clear wax 64 has hardened, the combination of the white inner wax filler 24, the blue wax plug 20, the blue outer wax layer 12, the at least one specifically shaped wax inlay 18, and the L-shaped metal release rod 48 is removed from the warmed mold 42 and inverted so that the blue wax plug 20 faces upward.

If necessary, the removed combination of the white inner wax filler 24, the blue wax plug 20, the blue outer wax layer 12, the at least one specifically shaped wax inlay 18, and the L-shaped metal release rod 48 may be burnt off using a propane torch to remove defects and improve the finish.

The L-shaped metal release rod 48 is removed from the centrally longitudinally disposed white inner wax filler throughbore of the white inner wax filler 24 from a white inner wax filler bottom 66.

The substantially rigid wick 28 is warmed and inserted in the centrally longitudinally disposed white inner wax filler throughbore of the white inner wax filler 24. The substantially rigid wick 28 contains a fine wire to assist in the insertion thereof.

The inverted combination of the white inner wax filler 24, the blue wax plug 20, the blue outer wax layer 12, the substantially rigid wick 28, and the at least one specifically shaped wax inlay 18 is placed on a hot plate 68 with the white inner wax filler bottom 66 of the white inner wax filler 24 in contact therewith.

The hot plate 68 is heated to a temperature of 225–250 degrees F. and levels the white inner wax filler bottom 66 of the white inner wax filler 24 and secures the substantially rigid wick 28 thereto.

Figure 12:
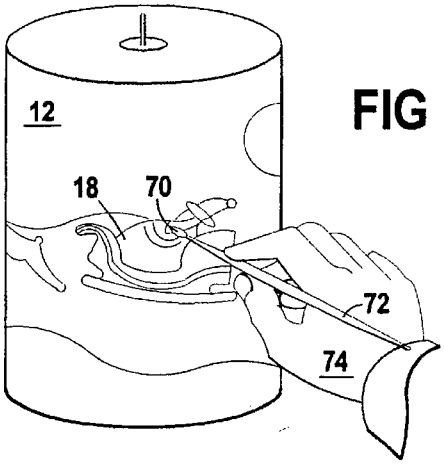
FIG. 12 is a diagrammatic perspective view illustrating how additional fine details may be painted or otherwise installed on the outer surface of the candle.

As shown in FIG. 12, additional colored decorative details 70 are applied to the blue outer wax layer 12 and the at least one specifically shaped wax inlay 18 by a brush 72 held by a hand 74.

Figure 13:
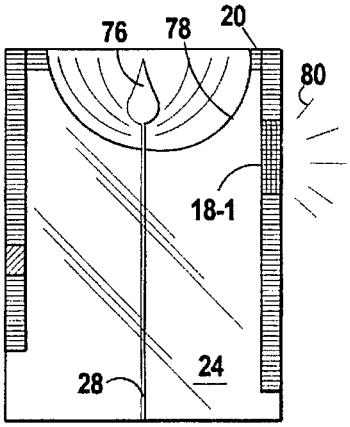
FIG. 13 is a diagrammatic cross sectional view, similar to FIG. 2, but illustrating the candle somewhat burnt with light emanating through a typical design.

The method of operation of the cookie cutter candle 10 can best be seen in FIG. 13, and as such, will be discussed with reference thereto.

The substantially rigid wick 28 is lit forming a flame 76. As the substantially rigid wick 28 continues to burn from the flame 76, the blue wax plug 20 and the white inner wax filler 24 melts forming a substantially hemispherical recess 78. The remaining part of the white inner wax filler 24 becomes hot.

When the white inner wax filler 24 becomes hot, it becomes translucent allowing light 80 from the flame 76 to pass therethrough. The light 80 is transmitted through the yellow moon shaped inlay 18-1 giving the illusion of moon rays.

It will be understood that each of the elements described above, or two or more together, may also find a useful application in other types of constructions differing from the types described above.

While the invention has been illustrated and described as embodied in a cookie cutter candle, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A decorative candle, comprising:

a) an outer wax layer having a color, a first side, a second side, a top with a length, a bottom with a length, an outer surface, and at least one specifically shaped aperture being disposed therethrough;

b) at least one specifically shaped wax inlay having a color different than the color of said outer wax layer, each of said at least one specifically shaped wax inlay being disposed in a respective one of said at least one specifically shaped aperture of said outer wax layer;

c) a wax plug having a perimeter, a centrally disposed throughbore and being disposed at said top of said outer wax layer, said outer wax layer and said wax plug defining a filler chamber;

d) an inner wax filler having a bottom, a centrally longitudinally disposed throughbore, and being disposed within said filler chamber; and e) a substantially rigid wick being disposed in said centrally longitudinally disposed throughbore of said inner wax filler.

2. The candle as defined in claim 1, wherein said length of said top of said outer wax layer is less than said length of said bottom of said outer wax layer, said first side of said outer wax layer tapers inwardly towards said second side of said outer wax layer so that when said outer wax layer is rolled and said first side of said outer wax layer meets said second side of said outer wax layer a hollow frustrum is formed that tapers upwardly towards said top of said outer wax layer.

3. The candle as defined in claim 1, wherein said wax plug has a diameter of at least 4" and said centrally disposed throughbore of said wax plug has a diameter of ¼"–2" to increase translucent quality therethrough.

4. The candle as defined in claim 1, wherein said outer wax layer and said at least one wax inlay have a thickness of ¼" to ¾" to increase translucent quality therethrough.

5. The candle as defined in claim 1, wherein said outer wax layer and said at least one wax inlay are made from 2 tablespoons of Mico 845, 4 teaspoons of Mico BS, ¼ teaspoon of Uvli, and 3 teaspoons of Fisher Trop 1 added to 4 pounds of wax having a melting point of 140 degrees F. so that stretch ability and adhesion is increased therebetween.

6. The candle as defined in claim 1, wherein said inner wax filler includes a plurality of irregularly shaped solid translucent wax chunks that have voids therebetween.

7. The candle as defined in claim 6, wherein said plurality of irregularly shaped solid translucent wax chunks are made from 1–2 teaspoons of Fisher Trop 1 added to4 pounds of wax having a 140 degree F. melting point.

8. The candle as defined in claim 6, wherein said inner wax filler further includes clear wax disposed in said voids between said plurality of irregularly shaped solid translucent wax chunks and in said centrally disposed throughbore of said wax plug.

9. The candle as defined in claim 8, wherein said inner wax filler further includes a pair of longitudinally disposed crescent shaped opposing voids that open into said bottom of said inner wax filler and extend to a point short of said wax plug.

10. The candle as defined in claim 9, wherein said inner wax filler further includes said clear wax disposed in said pair of longitudinally disposed crescent shaped voids.

11. The candle as defined in claim 10, wherein said clear wax is made from 1–2 teaspoons of Fisher Trop 1, ¼ teaspoon Uvli, and Mico 1702 added to4 pounds of wax having a 140 degree F. melting point.

12. The candle as defined in claim 1, wherein said outer surface of said outer wax layer includes additional colored decorative details.

13. The candle as defined in claim 1, wherein said at least one specifically shaped aperture of said outer wax layer is a moon shaped aperture.

14. The candle as defined in claim 13, wherein said at least one specifically shaped aperture of said outer wax layer is a sled shaped aperture.

15. The candle as defined in claim 14, wherein said at least one specifically shaped aperture of said outer wax layer is a Santa Claus shaped aperture.

16. The candle as defined in claim 15, wherein said at least one specifically shaped aperture of said outer wax layer is a reindeer shaped aperture.

17. The candle as defined in claim 16, wherein said at least one specifically shaped wax inlay is a moon shaped wax inlay.

18. The candle as defined in claim 17, wherein said at least one specifically shaped wax inlay is a sled shaped wax inlay.

19. The candle as defined in claim 18, wherein said at least one specifically shaped wax inlay is a Santa Claus shaped wax inlay.

20. The candle as defined in claim 19, wherein said at least one specifically shaped wax inlay is a reindeer shaped.

21. The candle as defined in claim 20; further comprising at least one cookie cutter.

22. The candle as defined in claim 21, wherein said at least one cookie cutter is a moon shaped cookie cutter that matches said moon shaped aperture of said at least one specifically shaped aperture of said outer wax layer and matches said moon shaped wax inlay of said at least one specifically shaped wax inlay.

23. The candle as defined in claim 22, wherein said at least one cookie cutter is a sled shaped cookie cutter that matches said sled shaped aperture of said at least one specifically shaped aperture of said outer wax layer and matches said sled shaped wax inlay of said at least one specifically shaped wax inlay.

24. The candle as defined in claim 23, wherein said at least one cookie cutter is a Santa Claus shaped cookie cutter that matches said Santa Claus shaped aperture of said at least one specifically shaped aperture of said outer wax layer and matches said Santa Claus shaped wax inlay of said at least one specifically shaped wax inlay.

25. The candle as defined in claim 24, wherein said at least one cookie cutter is a reindeer shaped cookie cutter that matches said reindeer shaped aperture of said at least one specifically shaped aperture of said outer wax layer and matches said reindeer shaped wax inlay of said at least one specifically shaped wax inlay.

26. A method of making a decorative candle, comprising the steps of:

a) making an outer wax layer of said decorative candle;

b) cutting at least one specifically shaped aperture in said outer wax layer;

c) making an inlay wax layer of said decorative candle;

d) cutting at least one specifically shaped inlay from said inlay wax layer;

e) placing said at least one specifically shaped inlay into a respective one of said at least one specifically shaped aperture in said outer wax layer;

f) kneading said at least one specifically shaped inlay to said outer wax layer;

g) heating said combination of said at least one specifically shaped inlay and said outer wax layer at 120–140 degree F. until soft and bonded;

h) rolling said combination of said at least one specifically shaped inlay and said outer wax layer;

i) placing said combination of said at least one specifically shaped inlay and said outer wax layer into a warmed mold having an open top and a closed bottom;

j) unrolling slowly said combination of said at least one specifically shaped inlay and said outer wax layer;

k) positioning said combination of said at least one specifically shaped inlay and said outer wax layer with a top of said outer wax layer against said closed bottom of the warmed mold and with a tapered first side of said outer wax layer meeting a straight second side of said outer wax layer and forming a hollow frustrum;

l) kneading said tapered first side of said outer wax layer to said straight second side of said outer wax layer to fill any gaps therebetween;

m) placing a wax plug of said decorative candle in the warmed mold against the closed bottom of the warmed mold with a perimeter of said wax plug pressing firmly against said top of said outer wax layer;

n) kneading said perimeter of said wax plug to said top of said outer wax layer to fill any gaps therebetween;

o) placing a L-shaped metal release rod having a longitudinal portion and a transverse portion extending outwardly from the longitudinal portion of the L-shaped metal release into the warmed mold with the longitudinal portion of the L-shaped metal release rod positioned in a centrally disposed throughbore of said wax plug and the transverse portion of the L-shaped metal release rod extending outwardly from the warmed mold open top of the warmed mold;

p) pouring a plurality of irregularly shaped solid translucent wax chunks of said decorative candle into the warmed mold until full and help keep said outer wax layer in place in the warmed mold;

q) pouring hot molten clear wax of said decorative candle, at a temperature of 220–240 degrees F., into the warmed mold surrounding said plurality of irregularly shaped solid translucent wax chunks and the longitudinal portion of the L-shaped metal release rod and entering said centrally disposed throughbore of said wax plug until full;

r) setting said combination of said hot molten clear wax, said plurality of irregularly shaped solid translucent wax chunks, the L-shaped metal release rod, and the warmed mold for 30–45 seconds;

s) placing said combination of said hot molten clear wax, said plurality of irregularly shaped solid translucent wax chunks, the L-shaped metal release rod, and the warmed mold into a water bath to be cooled;

t) making a pair of longitudinally disposed crescent shaped opposing voids in said hot molten clear wax with said pair of longitudinally disposed crescent shaped opposing voids opening into the open top of the warmed mold and extending to a point short of said wax plug, as said hot molten clear wax becomes a mush;

u) pouring additional hot molten clear wax into said pair of longitudinally disposed crescent shaped opposing voids;

v) hardening said additional hot molten clear wax and forming an inner wax filler of the decorative candle;

w) removing said combination of said white inner wax filler, said wax plug, said outer wax layer, said at least one specifically shaped wax inlay, and the L-shaped metal release rod from the warmed mold and inverting so that said wax plug faces upward;

x) removing the L-shaped metal release rod from a centrally longitudinally disposed throughbore of said inner wax filler from a bottom of said white inner wax filler;

y) inserting a warmed substantially rigid wick in said centrally longitudinally disposed throughbore of said inner wax filler;

z) placing said combination of said inner wax filler, said wax plug, said outer wax layer, said substantially rigid wick, and said at least one specifically shaped wax inlay on a hot plate with said bottom of said inner wax filler in contact therewith;

aa) heating the hot plate to a temperature of 225–250 degrees F.; and bb) leveling said bottom of said inner wax filler and securing said substantially rigid wick thereto.

27. The method as defined in claim 26; further comprising the step of applying additional colored decorative details to said combination of said outer wax layer and said at least one specifically shaped wax inlay by a brush.

28. The method as defined in claim 26, wherein said outer wax layer and said inlay wax layer have a thickness of ¼" to ¼" to increase translucent quality therethrough.

29. The method as defined in claim 28, wherein said outer wax layer and said inlay wax layer are made by a method comprising the steps of adding 2 tablespoons of Mico 845, 4 teaspoons of Mico BS, ¼ teaspoon of Uvli, and 3 teaspoons of Fisher Trop 1 to4 pounds of wax to increase ability to stretch and to increase adhesion therebetween.

30. The method as defined in claim 29, wherein said method of making said outer wax layer and said inlay wax layer further comprising the steps of pouring into a pre-warmed sheet pan, placing in a low temperature oven of 130–160 degrees F. until pliable, removing, and cooling.

31. The method as defined in claim 26, wherein said step of cutting said at least one specifically shaped aperture in said outer wax layer and said step of cutting said at least one specifically shaped inlay from said inlay wax layer is accomplished by a cookie cutter.

32. The method as defined in claim 26, wherein said plurality of irregularly shaped solid translucent wax chunks is made by a method comprising the step of adding 1–2 teaspoons of Fisher Trop 1 to4 pounds of wax having a 140 degree F. melting point.

33. The method as defined in claim 26, wherein said hot molten clear wax and said additional hot molten clear wax are made by a method comprising the steps of adding 1–2 teaspoons of Fisher Trop 1, ¼ teaspoon Uvli, and Mico 1702 to 4 pounds of wax having a 140 degree F. melting point.

* * * * *